US010183384B2

(12) United States Patent
Takano et al.

(10) Patent No.: US 10,183,384 B2
(45) Date of Patent: Jan. 22, 2019

(54) POWER TOOL

(71) Applicant: HITACHI KOKI CO., LTD., Tokyo (JP)

(72) Inventors: Nobuhiro Takano, Ibaraki (JP); Kazutaka Iwata, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 485 days.

(21) Appl. No.: 14/761,660

(22) PCT Filed: Mar. 18, 2014

(86) PCT No.: PCT/JP2014/057215
§ 371 (c)(1),
(2) Date: Jul. 17, 2015

(87) PCT Pub. No.: WO2014/162862
PCT Pub. Date: Oct. 9, 2014

(65) Prior Publication Data

US 2016/0008961 A1 Jan. 14, 2016

(30) Foreign Application Priority Data

Mar. 30, 2013 (JP) ..... 2013-075473

(51) Int. Cl.
*B25B 21/02* (2006.01)
*B25F 5/00* (2006.01)

(52) U.S. Cl.
CPC ..... *B25B 21/02* (2013.01); *B25F 5/00* (2013.01)

(58) Field of Classification Search
CPC ... B25B 21/02; B25B 21/026; B25B 23/1475; B25F 5/00
(Continued)

(56) References Cited

U.S. PATENT DOCUMENTS 6,687,567 B2 * 2/2004 Watanabe ..... B25B 23/1405 173/11
8,552,669 B2 * 10/2013 Kusakawa ..... H02P 7/29 318/139
(Continued)

FOREIGN PATENT DOCUMENTS

CN 101372095 A 2/2009
CN 102917842 A 2/2013
(Continued)

OTHER PUBLICATIONS

Chinese Office Action for the related Chinese Patent Application No. 201480008042.8 dated May 12, 2017.
(Continued)

*Primary Examiner* — Andrew M Tecco
*Assistant Examiner* — Nicholas Igbokwe
(74) *Attorney, Agent, or Firm* — Kenealy Vaidya LLP

(57) ABSTRACT

The purpose of the present invention is to use a motor with as high an output as possible to complete tightening operations at a high speed while limiting continuous drive output. In a power tool having a plurality of impact operation modes, the motor thereof is controlled at a 100% duty cycle so as to rotate at a high speed in the period between pulling of a trigger and starting of an impact operation (71*a*-71*b*), and the duty cycle is changed to a low duty cycle matching the appropriate operation mode after an impact by an impact mechanism is started and a predetermined stroke is performed so that the motor is driven at the low duty cycle until the trigger is returned (arrow 71*c*-71*d*). The switching of the duty cycle is performed when the current flowing to the motor exceeds a threshold ($I_1$).

8 Claims, 11 Drawing Sheets

(58) Field of Classification Search
USPC ..... 173/2, 93, 173
See application file for complete search history.

(56) References Cited

U.S. PATENT DOCUMENTS

| | | | | |
|---|---|---|---|---|
| 2002/0060082 | A1* | 5/2002 | Watanabe | B25B 21/02 173/176 |
| 2009/0051306 | A1* | 2/2009 | Matsunaga | B25F 5/00 318/434 |
| 2009/0206783 | A1* | 8/2009 | Zhao | H02P 1/04 318/430 |
| 2010/0096155 | A1* | 4/2010 | Iwata | B25B 21/02 173/176 |
| 2010/0307782 | A1* | 12/2010 | Iwata | B25F 5/00 173/1 |
| 2010/0308764 | A1* | 12/2010 | Suzuki | B25F 5/00 318/494 |
| 2011/0284255 | A1* | 11/2011 | Ookubo | B23B 45/02 173/109 |
| 2012/0279736 | A1* | 11/2012 | Tanimoto | B25B 21/02 173/2 |
| 2012/0318550 | A1* | 12/2012 | Tanimoto | B25B 23/1405 173/117 |
| 2013/0008679 | A1* | 1/2013 | Nishikawa | B25B 21/02 173/93 |
| 2013/0062086 | A1 | 3/2013 | Ito et al. | |
| 2013/0076271 | A1* | 3/2013 | Suda | B25F 5/00 318/3 |

FOREIGN PATENT DOCUMENTS

| | | | |
|---|---|---|---|
| EP | 2 027 974 | A2 | 2/2009 |
| EP | 2 572 832 | A1 | 3/2013 |
| JP | 5-104454 | A | 4/1993 |
| JP | 7-116969 | A | 5/1995 |
| JP | 2007-7852 | A | 1/2007 |
| JP | 2008-278633 | A | 11/2008 |
| JP | 2009-72889 | A | 4/2009 |

OTHER PUBLICATIONS

International Search Report for PCT/JP2014/057215 dated Apr. 28, 2014.
Extended European search report for the related European Patent Application No. 14778213.0 dated Nov. 15, 2016.
Chinese Office Action for the related Chinese Patent Application No. 201480008042.8 dated Nov. 30, 2017.

* cited by examiner

POWER TOOL

This application is a U.S. national phase filing under 35 U.S.C. § 371 of PCT Application No. PCT/JP2014/057215, filed Mar. 18, 2014, and which in turn claims priority under 35 U.S.C. § 119 to Japanese Patent Application No. JP2013-075473, filed Mar. 30, 2013, the entireties of which are incorporated by reference herein.

TECHNICAL FIELD

The invention relates to a power tool, and more particularly to, a power tool having improved a control method of a motor to be used as a driving source.

BACKGROUND ART

Regarding a hand-held power tool, a cordless impact tool that is driven by the electric energy accumulated in a battery is widely used. In the impact tool where a tip tool such as a drill or a driver is rotationally driven by a motor to thus perform a required operation, the battery is used to drive a brushless DC motor, as disclosed in PTL 1, for example. The brushless DC motor refers to a DC (direct current) motor that has no brush (brush for rectification). The brushless DC motor employs a coil (winding) at a rotor-side and a permanent magnet at a stator-side and has a configuration where power driven by an inverter is sequentially energized to a predetermined coil to thus rotate the rotor. The brushless DC motor has higher efficiency than a motor having a brush and can obtain a high output while using a rechargeable secondary battery. Also, since the brushless DC motor includes a circuit on which a switching element for rotationally driving the motor is mounted, it is easy to achieve an advanced rotation control of the motor by an electronic control.

The brushless DC motor includes a rotor having a permanent magnet and a stator having multiple-phase armature windings (stator windings) such as three-phase windings. In the brushless DC motor, a position detection element configured by a plurality of Hall ICs configured to detect a position of the rotor by detecting a magnetic force of the permanent magnet of the rotor and an inverter circuit configured to drive the rotor by switching a direct current voltage supplied from a battery pack and the like with semiconductor switching elements such as FET (Field Effect Transistor) or IGBT (Insulated Gate Bipolar Transistor) and changing energization to the stator winding of each phase are used. The inverter circuit is configured to be controlled by a microcomputer and to set energization timing of the armature winding of each phase on the basis of position detection results of the rotor by the position detection elements such as Hall ICs.

CITATION LIST

Patent Literature

PTL 1: Japanese Patent Application Publication No. 2008-278633A

SUMMARY OF THE INVENTION

Problems that the Invention is to Solve

In recent years, the output of the power tool has been increased and it is thus possible to obtain a high rotational speed and high fastening torque while reducing a size of the tool as the brushless DC motor is used. However, realizing the high fastening torque causes striking stronger beyond necessity to be applied in a screw fastening operation or the like. Therefore, it is important to select a motor having appropriate output and characteristic in conformity to the necessary fastening torque. In particular, when the output of the motor is more increased than necessary in the impact tool, a possibility that a head of the screw will be damaged becomes higher and a lifespan or temperature increase upon continuous operation is limited. From these standpoints, it may be considered to limit the output of the motor. For this reason, the power tool may not maximize the potential that is obtained by the motor.

It is therefore an object of the invention to provide a power tool capable of completing a fastening operation at a high speed while limiting a continuous driving output by using a motor having an output as high as possible.

Another object of the invention is to provide a power tool having a high motor output and high durability capable of preventing breakage of a screw head or bolt upon striking.

Yet another object of the invention is to provide a power tool capable of suppressing a temperature increase of a motor to thus rapidly complete a fastening operation with appropriate torque by controlling the motor, which has a sufficiently high output as regards a fastening target, to lower an upper limit of a duty ratio just after seating is made.

Means for Solving the Problems

Representative features of the invention to be disclosed in the specification are as follows.

According to one feature of the present invention, there is provided a power tool including a motor configured to be driven by PWM controlling a semiconductor switching element; a trigger configured to adjust startup and rotation of the motor; an impact mechanism configured to strike or rotate an anvil by a hammer that is rotated by the motor, and a control means for controlling rotation of the motor, wherein when a plurality of striking is continuously performed by the impact mechanism, the motor is driven at a state where a duty ratio is changed from a high value to a low value. By this configuration, it is possible to effectively protect the power tool from the temperature increase or mechanical stress, which is caused as the high-output motor is continuously driven. Thus, it is possible to implement the power tool having the high reliability and long lifespan. Also, the higher output, higher rotation speed motor than the motor of the related art can be positively used, so that it is possible to rapidly complete the fastening operation. The power tool preferably has a plurality of operation modes having different fastening torques. Also in this case, the power tool is configured to perform control at a high duty ratio, irrespective of the operation modes, in a high duty ratio zone, and the power tool is configured to perform control at a low duty ratio set depending on each of the operation modes, in a low duty ratio zone. Preferably, the high duty ratio is 100% and the low duty ratio is 70% or lower, more preferably 50% or lower. By this configuration, it is possible to perform the fastening operation at the high speed in a light-load, so-called free run zone at any setting mode, thereby shortening the operation time. As compared to the related art where only a motor having an output, which does not cause thermal and mechanical problems even though the motor is continuously driven at the duty ratio of 100%, is used, it is possible to adopt a higher-output motor by 10% or higher.

According to another feature of the present invention, a current detection means for detecting a current value flowing through the motor or semiconductor switching element is provided, and when a current value, which is detected by the current detection means when the power tool is driven at the high duty ratio, exceeds a first threshold $I_1$, the control means switches the duty ratio from the high duty ratio to the low duty ratio. By this configuration, it is possible to securely change the duty ratio, depending on the load state or fastening state. Also, since the control of the present invention can be implemented by applying the current detection, which has been used, without separately preparing a special detection sensor for switching the duty ratio, it is possible to easily implement the present invention. Also, a second threshold $I_2$ ($I_2>I_1$), instead of the first threshold $I_1$, is used in a short specific time period after the trigger is pulled, and when the current value exceeds the second threshold $I_2$, the control means switches the duty ratio from the high duty ratio to the low duty ratio. Thereby, the double tightening of a bolt and the like is detected. In case of the double tightening, the duty ratio is immediately decreased to protect a fastening member, the motor and the mechanism part. By this configuration, even when an operator intends to tighten twice the fastened bolt and the like for any reason, it is possible to prevent the excessive current from flowing through the motor and to prevent the mechanically excessive load from being applied to the mechanism part.

According to another feature of the present invention, there is provided a power tool including a motor configured to be driven by an inverter circuit having a semiconductor switching element; a trigger configured to adjust startup and rotation of the motor; an impact mechanism configured to strike or rotate an anvil by a hammer that is rotated by the motor, and a control means for controlling rotation of the motor, wherein just after the trigger is pulled, a rotation speed of the motor is controlled at a low speed and at constant rotation for a predetermined time period with a rotation control of the motor being in non-conjunction with a pulling amount of the trigger. By this configuration, it is possible to improve the biting property when fastening a wood screw into a target material. In particular, since the motor is automatically controlled at the optimal rotation speed and the rotation speed is constantly kept in the power tool, it is possible to effectively prevent the phenomenon that a screw falls down without biting into the target material. Further, since it is not necessary for the operator to finely adjust or keep the pulling amount of the trigger, it is possible to implement the power tool having a user-friendly screw mode. Also, a third threshold $I_3$ and a fourth threshold $I_4$ ($I_3>I_4$) are provided with respect to a current value detected by the current detection means, when the current value is equal to or greater than the third threshold $I_3$ and smaller than the fourth threshold $I_4$ in a short specific time period just after the trigger is pulled while the motor is controlled, the control means continues to drive the motor at the low speed and at the constant rotation, and when the detected current value exceeds the fourth threshold $I_4$, the control means switches the control to a rotation control of the motor being in conjunction with the trigger. By this configuration, it is possible to securely continue the screw fastening operation at the low speed and at the constant rotation until the biting of the screw is completed. In the meantime, a configuration of automatically executing a mode (screw mode) in which a first pulling amount of the trigger is monitored and when the first pulling amount is small, the rotation speed of the motor is controlled at the low speed and at the constant rotation for a predetermined time period in non-conjunction with the pulling amount of the trigger is also possible. By this configuration, it is not necessary for the operator to set the screw mode when it is needed. Also, when the motor is started with a predetermined small amount, which is the first pulling amount of the trigger, the screw mode is automatically executed. Therefore, it is possible to implement the power tool that can be very easily used.

According to another feature of the present invention, when an increase rate of a current value detected by the current detection means is continuously kept at a high state, the motor is driven at a state where the duty ratio is changed from the high value to the low value. Therefore, the duty ratio is decreased after it is confirmed by the increase rate that the plurality of striking is continuously performed. Thereby, for example, when the sands are caught in the screw and the torque is thus instantaneously increased, it is possible to prevent the power tool from erroneously decreasing the duty ratio, so that it is possible to securely solve the problem of the screw tightening deficiency. Also, when the fastening member is seated by the plurality of striking by the impact mechanism, the motor is driven at the state where duty ratio is changed from the high value to the low value. That is, since the screw is continuously tightened at the high duty ratio until the seating is made, it is possible to fasten the screw with the high torque from the free run state to the moment of the seating. Thereafter, the duty ratio is decreased and the fastening is continuously performed, so that the fastening torque comes close to a predetermined value and a deviation of the fastening torque for each screw can be thus suppressed.

Effects of the Invention

According to the present invention, it is possible to provide the power tool having a high output and capable of shortening the fastening time. Also, it is possible to provide the power tool of which operability is very high. The foregoing and other objects and novel features of the invention will be apparent from the below descriptions and accompanying drawings.

DESCRIPTION OF EMBODIMENTS

First Illustrative Embodiment

Figure 1:
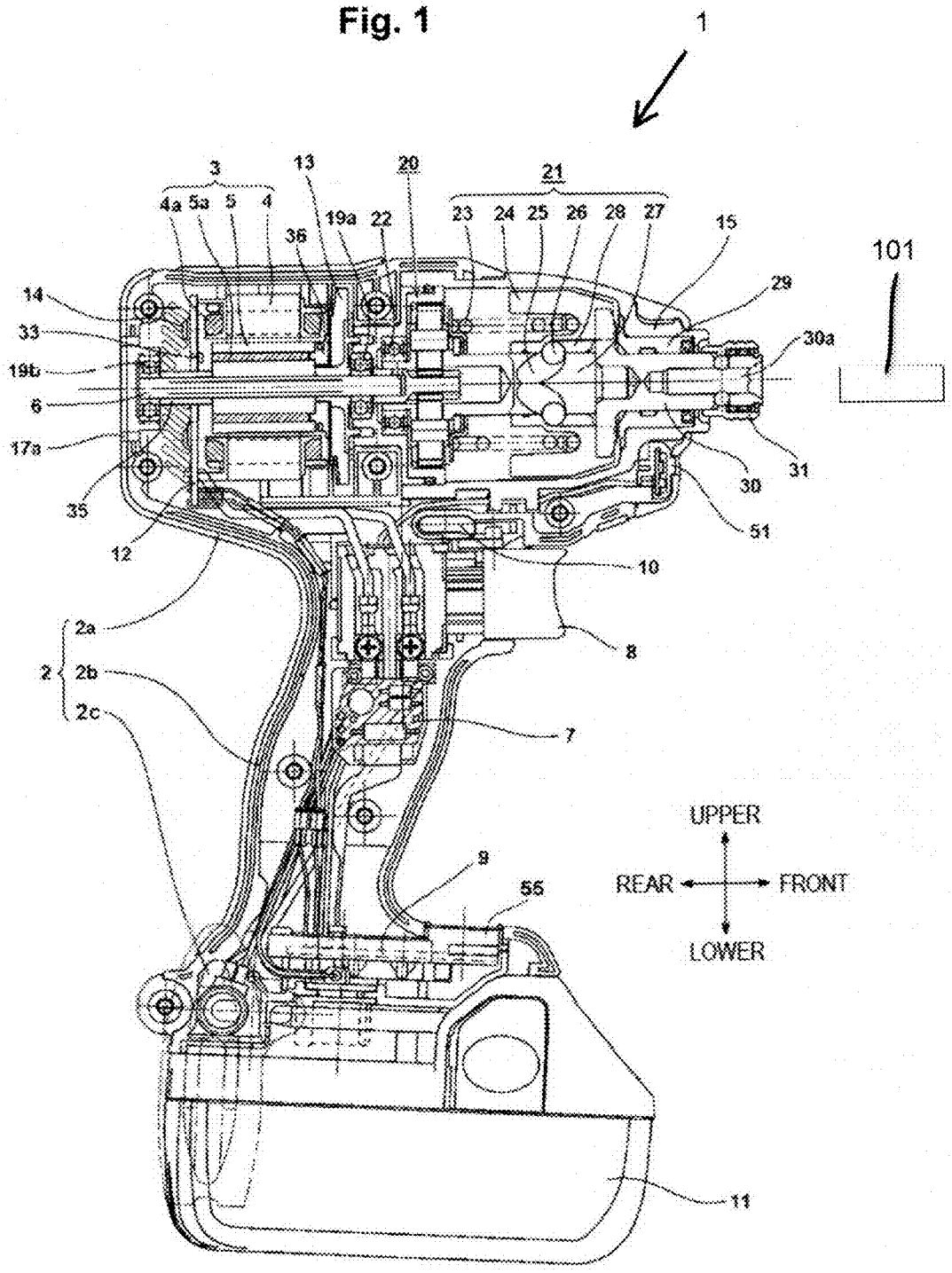
FIG. 1 A sectional view illustrating an internal structure of an impact tool 1 according to an illustrative embodiment of the invention.

Hereinafter, illustrative embodiments of the invention will be described with reference to the drawings. In the following descriptions, an upper-lower direction and a front-rear direction are referred to as the directions shown in the drawings. FIG. 1 is a sectional view illustrating an internal structure of a power tool according to an illustrative embodiment of the invention. In this illustrative embodiment, an impact tool 1 is exemplified as the power tool.

The impact tool 1 is configured to use a rechargeable battery 9 as a power supply and to use a motor 3 as a driving source. The impact tool 1 is configured to drive an output part, such as impact mechanism 21 while decelerating the same with a predetermined speed reduction ratio by a deceleration mechanism 20 and to thus apply a rotational force and a striking force to an anvil 30 that is an output shaft, thereby intermittently transmitting the rotational striking force to a tip tool (not shown) such as a driver bit, which is mounted in a mounting hole 30*a* and is held by a mounting mechanism 31, to thus fasten fastening member 101, such as a screw or bolt.

The motor 3 is a brushless DC motor, has a rotor 5 having two sets of magnets 5 arranged on an inner periphery of the motor and a stator 4 having windings 4*a* wound in six slots on an outer periphery thereof, and is a so-called four-pole, six-slot motor. In the meantime, the present invention is not limited to the four-pole, six-slot motor and may adopt a motor having other poles and slots. The motor 3 is accommodated in a cylindrical trunk part 2*a* of a housing 2 having a substantial T-shape, as seen from the side. A rotary shaft 6 of the motor 3 is rotatably held by a bearing 19*a*, which is provided near a center of the trunk part 2*a* of the housing 2, and a bearing 19*b* that is provided at a rear end-side thereof. A rotor fan 13 that is coaxially mounted with the rotary shaft 6 and is rotated in synchronous with the motor 3 is provided in front of the motor 3. An inverter circuit board 12 for driving the motor 3 is arranged at the rear of the motor 3.

Air flow that is generated by the rotor fan 13 is introduced into the trunk part 2*a* through an air inlet 17*a* and a slit (a slit 17*b* in FIG. 2) (which will be described later) formed on a portion of the housing around the inverter circuit board 12, mainly flows to pass through between the rotor 5 and the stator 4, is sucked form the rear of the rotor fan 13 and flows in a diametrically outer direction of the rotor fan 13. Then, the air flow is discharged to the outside of the housing 2 through a slit (a slit 18 in FIG. 2) (which will be described later) formed on a portion of the housing around the rotor fan 13. The inverter circuit board 12 is a double-sided board having the substantially same circular shape as an outer shape of the motor 3. A plurality of switching elements 14 such as FETs (Field Effect Transistors) and position detection elements 33 such as Hall ICs are mounted on the inverter circuit board.

A sleeve 36 and the rotor fan 13 are mounted coaxially with the rotary shaft 6 between the rotor 5 and the bearing 19*a*. The rotor 5 forms a magnetic path formed by the magnets 5*a*. The sleeve 36 may be made of plastic or metal, for example. When the sleeve is made of metal, the sleeve is preferably made of a non-magnetic material so as not to influence the magnetic path of the rotor 5.

The rotor fan 13 is integrally formed by plastic molding, for example. The rotor fan is a so-called centrifugal fan configured to suck the air from an inner peripheral side at the rear and to discharge the air radially outwardly at the front side. A plastic spacer 35 is provided between the rotor 5 and the bearing 19*b*. The spacer 35 has a substantially cylindrical shape and is configured to set a gap between the bearing 19*b* and the rotor 5. The gap is required to coaxially arrange the inverter circuit board 12 and to form a space that is necessary as a flow path of the air flow to cool the switching elements 14.

A trigger 8 is arranged on an upper part of a handle part 2*b* that extends substantially at a right angle from and integrally with the trunk part 2*a* of the housing 2. A switch circuit board 7 is provided below the trigger 8. A control circuit board 9 having a function to control the speed of the motor 3 by an operation of pulling the trigger 8 is accommodated in a lower part of the handle part 2*b*. The control circuit board 9 is electrically connected to the battery 11 and the switch circuit board 7. The control circuit board 9 is connected to the inverter circuit board 12 through a signal line. To a battery attaching part 2*c* below the handle part 2*b*, the battery 11 including a nickel-cadmium battery, a lithium-ion battery or the like is detachably attached.

The impact mechanism 21 that is provided at an output-side of the planetary gear deceleration mechanism 20 has a spindle 27 and a hammer 24. A rear end of the impact mechanism is rotatably held by a bearing 22 and a front end thereof is rotatably held by a metal 29. When the trigger 8 is pulled and thus the motor 3 is enabled to start, the motor 3 starts to rotate in a direction set by a forward/reverse switching lever 10. The rotational force of the motor is decelerated by the deceleration mechanism 20 and transmitted to the spindle 27, so that the spindle 27 is rotationally driven at a predetermined speed. Here, the spindle 27 and the hammer 24 are connected to each other by a cam mechanism. The cam mechanism includes a V-shaped spindle cam recess 25 formed on an outer peripheral surface of the spindle 27, a hammer cam recess 28 formed on an inner peripheral surface of the hammer 24 and balls 26 that are engaged with the cam recesses 25, 28. The hammer 24 is all the time urged forward by a spring 23. When stationary, the hammer 24 is located at a position spaced from an end surface of the anvil 30 by engagement of the balls 26 and the spindle cam recesses 25, 28. Convex portions (not shown) are symmetrically formed at two locations on rotation planes of the hammer 24 and the anvil 30, which are opposed to each other.

When the spindle 27 is rotationally driven, the rotation of the spindle is transmitted to the hammer 24 through the cam mechanism. At this time, the convex portion of the hammer 24 is engaged with the convex portion of the anvil 30 while the hammer 24 does not make a half turn, so that the anvil 30 is rotated. However, when relative rotation is generated between the spindle 27 and the hammer 24 due to an engagement reaction force at that time, the hammer 24 starts to retreat towards the motor 3 while compressing the spring 23 along the spindle cam recess 25 of the cam mechanism. When the convex portion of the hammer 24 gets beyond the convex portion of the anvil 30 by the retreating movement of the hammer 24 and the engagement between these convex portions is thus released, the hammer 24 is rapidly accelerated in the rotation direction and in the forward direction by the action of the cam mechanism and the elastic energy accumulated in the spring 23, in addition to the rotational force of the spindle 27. Further, the hammer 24 is moved forward by the urging force of the spring 23 and the convex portion of the hammer 24 is again engaged with the convex portion of the anvil 30, so that the hammer starts to rotate integrally with the anvil. At this time, since a powerful rotational striking force is applied to the anvil 30, the rotational striking force is transmitted to a screw through the tip tool (not shown) mounted in the mounting hole 30*a* of the anvil 30. Thereafter, the same operation is repeatedly performed and thus the rotational striking force is intermittently and repeatedly transmitted from the tip tool to the screw, so that the screw is screwed into a member to be fastened (not shown) such as wood, for example.

Figure 2:
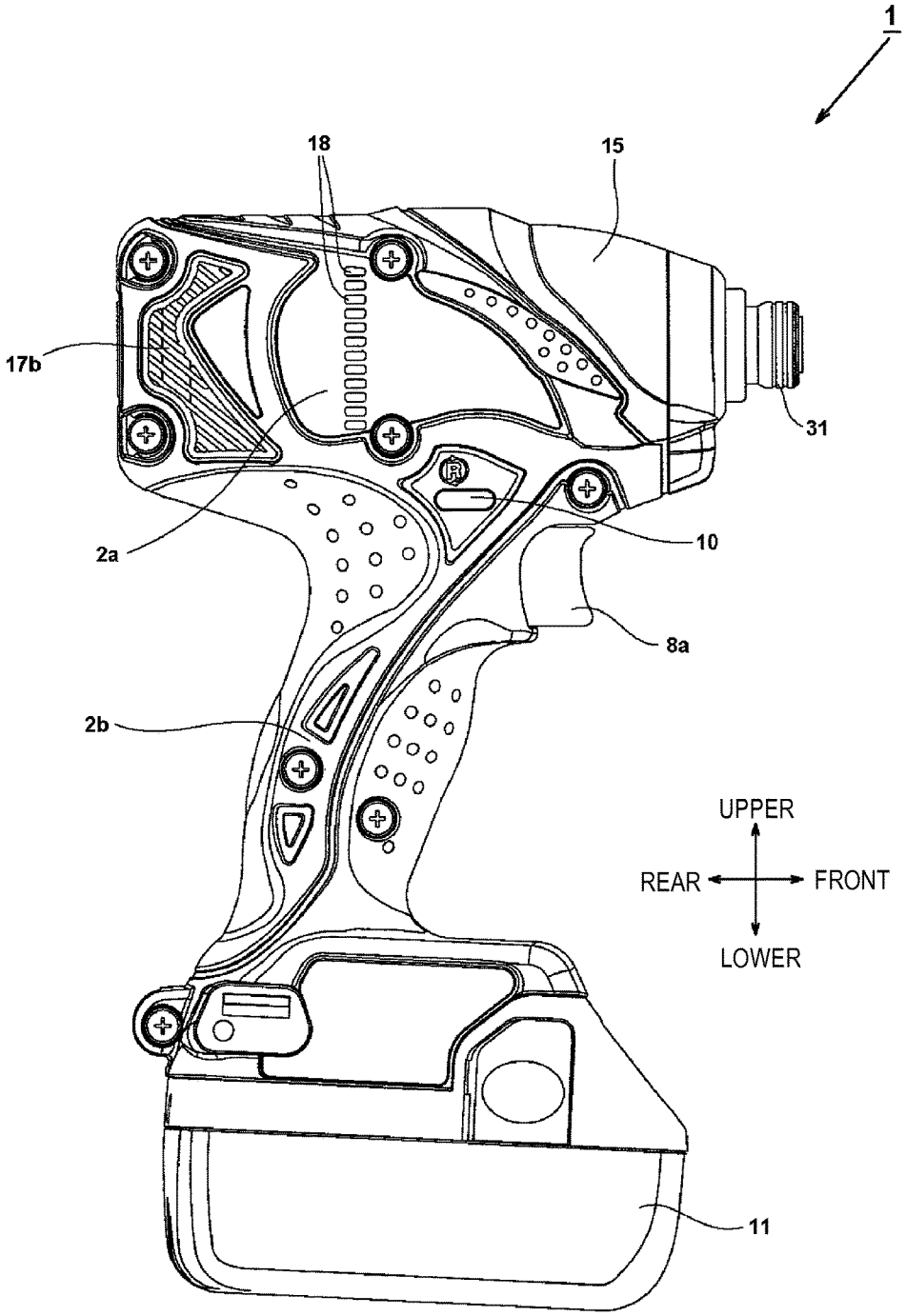
FIG. 2 A side view illustrating an outward appearance of the impact tool 1 according to the illustrative embodiment of the invention.

FIG. 2 is a side view illustrating an outward appearance of the impact tool 1 according to the illustrative embodiment of the invention. In FIG. 2, the slit 17*b* for air suction is formed on an outer periphery-side of the inverter circuit board 12 of the trunk part 2*a* of the housing 2 and the slits 18 are formed on an outer periphery portion of the rotor fan 13. A hammer case 15 made of metal and having a cup shape is provided at a front-side of the housing 2. The hammer case 15 is configured to accommodate therein the deceleration mechanism 20 and the impact mechanism 21 and is formed with a hole at a front portion equivalent to a bottom part of the cup through which the anvil 30 passes. The mounting mechanism 31 is provided on an outer side of the hammer case 15.

Figure 3:
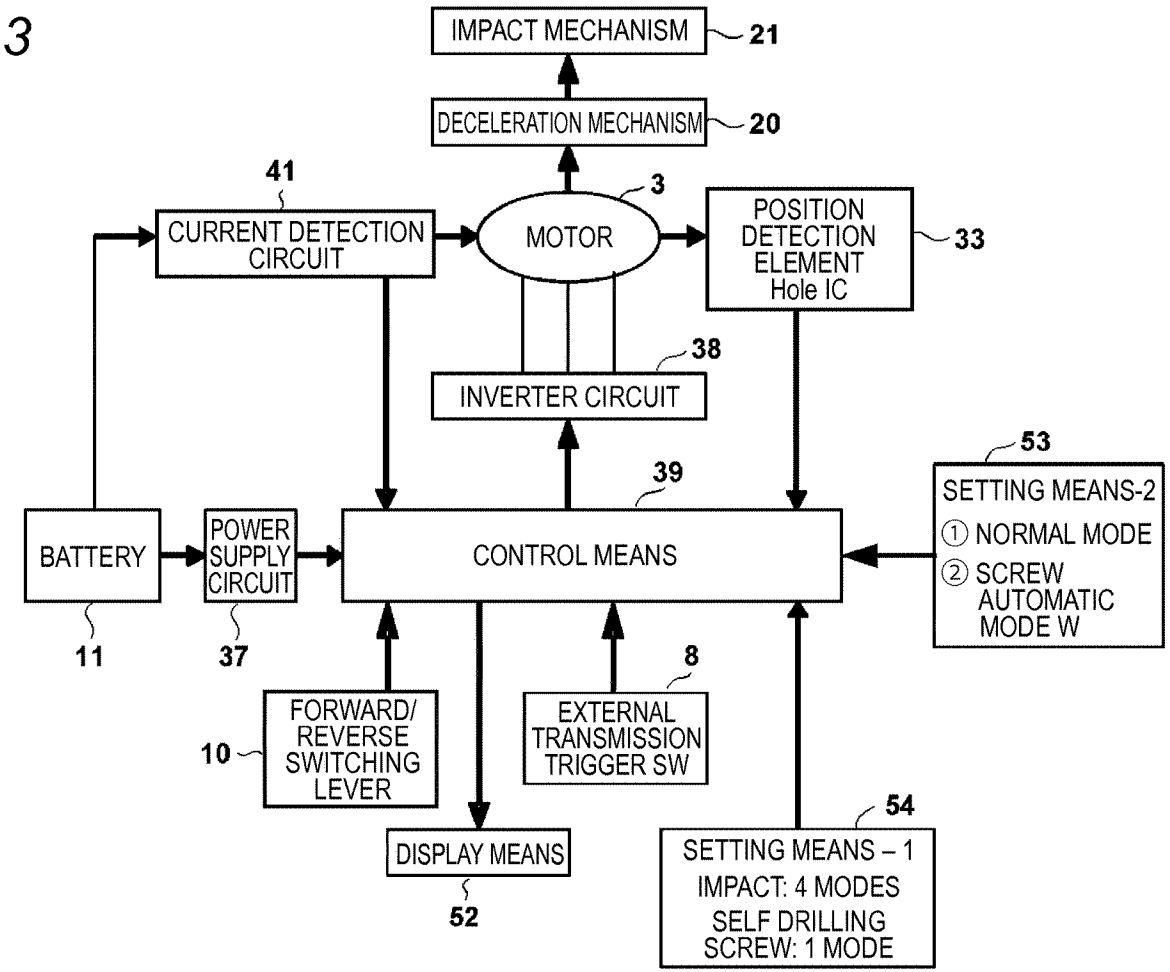
FIG. 3 A schematic block diagram of the impact tool 1 according to the illustrative embodiment of the invention.

FIG. 3 is a schematic block diagram of the impact tool 1 according to the illustrative embodiment of the invention. In this illustrative embodiment, the battery 11 consisting of a secondary battery is used as the power supply and the brushless DC motor is used as the motor 3 that is a driving source. In order to control the brushless DC motor, a control means 39 is used to drive an inverter circuit 38 consisting of a plurality of semiconductor switching elements. The control means 39 is driven by a low voltage that is generated by a power supply circuit 37 using the power of the battery 11. Three power lines are connected to the motor 3 from the inverter circuit 38. Driving current is supplied to a predetermined phase by the inverter circuit 38, so that the motor 3 is rotated. The output of the motor 3 is transmitted to the deceleration mechanism 20 and the impact mechanism 21 is driven by the rotational force decelerated by the deceleration mechanism 20. In order to drive the motor 3 by the control means 39, the position detection elements (the Hall ICs) 33 configured to generate signals for position detection of the rotor 5 are provided near the motor 3, and outputs of the position detection elements 33 are input to the control means 39. A signal of the forward/reverse switching lever 10 and a signal of the trigger 8 are input to the control means 39. Also, a first setting means 54 and a second setting means 53 are provided as a motor for driving the motor 3. In the first setting means 54, it is possible to set four operation modes in which the rotation speed of the motor is set and the fastening torque is divided into four stages, as an impact mode. Also, it is possible to set one teks mode (self drilling screw mode) for fastening a teks screw (self drilling screw). In the second setting means 53, it is possible to set a normal mode and a screw mode. The first setting means 54 and the second setting means 53 may be provided on an operation panel 55 (refer to FIG. 1), for example.

Figure 4:
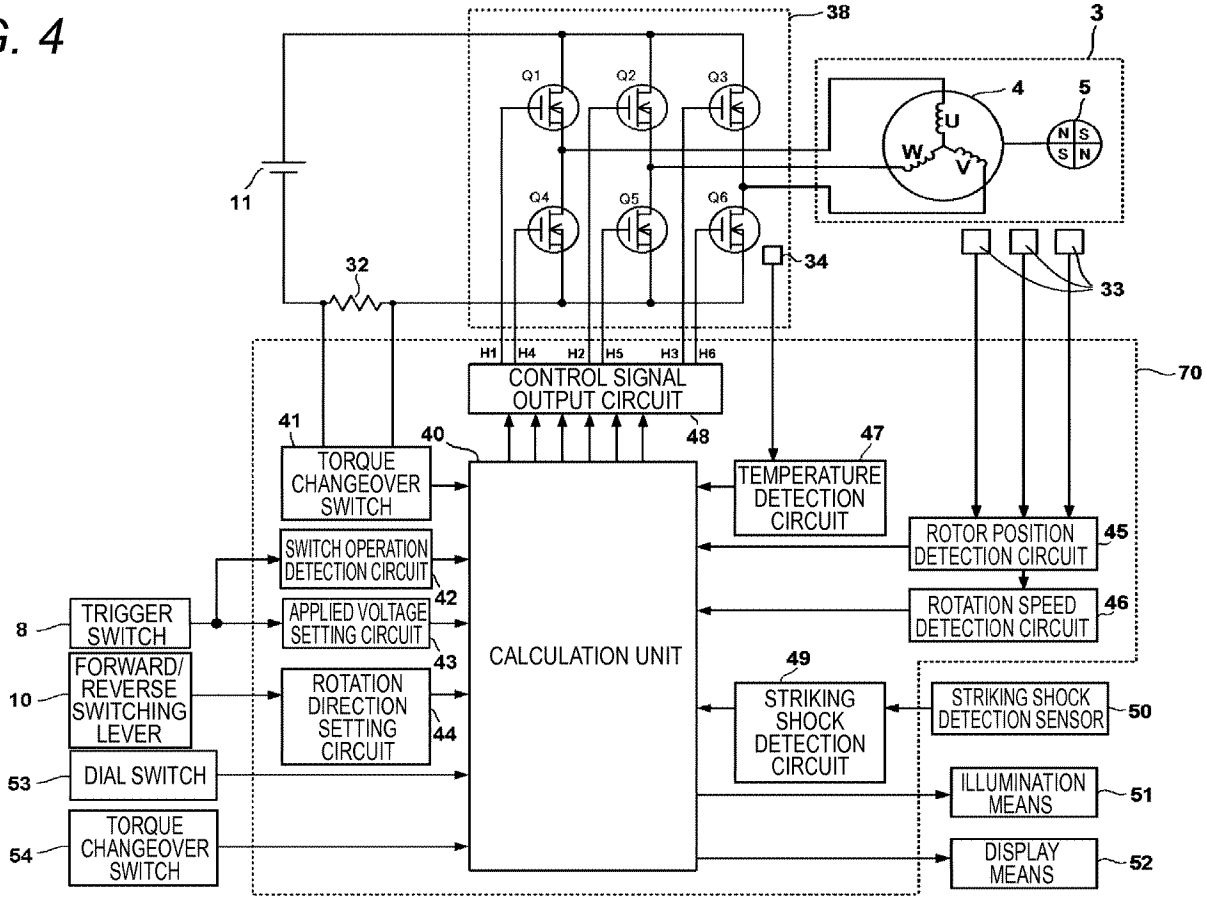
FIG. 4 A block diagram showing a circuit configuration of a drive control system of a motor 3 in the impact tool according to the illustrative embodiment of the invention.

Subsequently, a configuration and an operation of a drive control system of the motor 3 are described with reference to FIG. 4. FIG. 4 is a block diagram showing a configuration of the drive control system of the motor. In this illustrative embodiment, the motor 3 is composed of a three-phase brushless DC motor. The motor 3 is a so-called inner rotor type and includes the rotor 5 configured by embedding the magnets 5*a* (permanent magnets) having a pair of N-pole and S-pole, the three position detection elements 33 arranged at an angle of 60° to detect the rotation position of the rotor 5, and the stator 4 composed of star-connected three-phase windings U, V, W, which are controlled at a current energization interval of an 120° electrical angle on the basis of position detection signals from the position detection elements 33.

The inverter circuit 38 that is mounted on the inverter circuit board 12 is configured by six FETs (hereinafter, simply referred to as "transistor") Q1 to Q6, which are connected in a three-phase bridge form, and a flywheel diode (not shown). A temperature detection element (thermistor) 34 is fixed at a position close to the transistor on the inverter circuit board 12. Each gate of the six bridge-connected transistors Q1 to Q6 is connected to a control signal output circuit 48. Also, a source or drain of the six transistors Q1 to Q6 is connected to the star-connected armature windings U, V, W. Thereby, the six transistors Q1 to Q6 are configured to perform a switching operation by a switching element driving signal output from the control signal output circuit 48, and to supply power to the armature windings U, V, W by using the DC voltage of the battery 11 applied to the inverter circuit as the three-phase (U phase, V phase, W phase) AC voltages Vu, Vv, Vw.

An calculation unit 40, a current detection circuit 41, a switch operation detection circuit 42, an applied voltage setting circuit 43, a rotation direction setting circuit 44, a rotor position detection circuit 45, a rotation speed detection circuit 46, a temperature detection circuit 47, the control signal output circuit 48 and a striking shock detection circuit 49 are mounted on the control circuit board 9. Although not shown, the calculation unit 40 includes a CPU for outputting a driving signal based on a processing program and data, a ROM for storing therein a program corresponding to a flowchart (which will be described later) or control data, a RAM for temporarily storing therein data, and a microcomputer having a timer and the like embedded therein. The current detection circuit 41 is a current detection means for detecting current flowing through the motor 3 by measuring a voltage across a shunt resistance 32, and the detected current is input to the calculation unit 40. In this illustrative embodiment, the shunt resistance 32 is provided between the battery 11 and the inverter circuit 38 to thus detect the current value flowing through the semiconductor switching element. Alternatively, the shunt resistance may be provided between the inverter circuit 38 and the motor 3 to thus detect the current value flowing through the motor 3.

The switch operation detection circuit 42 is configured to detect whether the trigger 8 is pulled or not and to output an on signal to the calculation unit 40 when the trigger 8 is pulled even if only slightly. The applied voltage setting circuit 43 is a circuit for setting an applied voltage of the motor 3, that is, a duty ratio of a PWM signal, in response to a moving stroke of the trigger 6. The rotation direction setting circuit 44 is a circuit for setting the rotation direction of the motor 3 by detecting a forward rotation or reverse rotation operation using the forward/reverse switching lever 10 of the motor. The rotor position detection circuit 45 is a circuit for detecting a positional relation between the rotor 5 and the armature windings U, V, W of the stator 4, based on the output signals of the three position detection elements 33. The rotation speed detection circuit 46 is a circuit for detecting the rotation speed of the motor based on the speed of the detection signals from the rotor position detection circuit 45, which is counted in unit time. The control signal output circuit 48 is configured to supply a PWM signal to the transistors Q1 to Q6, based on the output from the calculation unit 40. The power supplied to each of the armature windings U, V, W is adjusted by controlling a pulse width of the PWM signal and the rotation speed of the motor 3 in the set rotation direction can be thus controlled. The striking shock detection circuit 49 is configured to detect a point of time at which striking is performed by the impact mechanism 21 or a magnitude of the torque thereof, based on a detection signal from a striking shock detection sensor 50. In the meantime, a gyro senor (not shown) or other arbitrary sensor may be provided, instead of the striking shock detection sensor 50 or in addition to the striking shock detection sensor 50.

An output signal of the dial switch 53 for switching an operation mode and an output signal of the toque changeover switch 54 for setting a torque value (or the rotation speed of the motor) are input to the calculation unit 40. The calculation unit 40 is further configured to control lighting of an illumination means 51 such as an LED for illuminating the vicinity of the tip tool. The lighting may be controlled by determining whether a lighting switch (not shown) is pressed or not by the calculation unit 40 or may be made in conjunction with a pulling operation of the trigger 8. A display means 52 is to display an intensity of a set torque value, a remaining amount of the battery and the other information and is configured to display the information by an optical means. In this illustrative embodiment, a plurality of LEDs, an LED indicator capable of displaying a speed and an alphabet by seven or more segments, a liquid crystal indicator and the like may be used.

Figure 5:
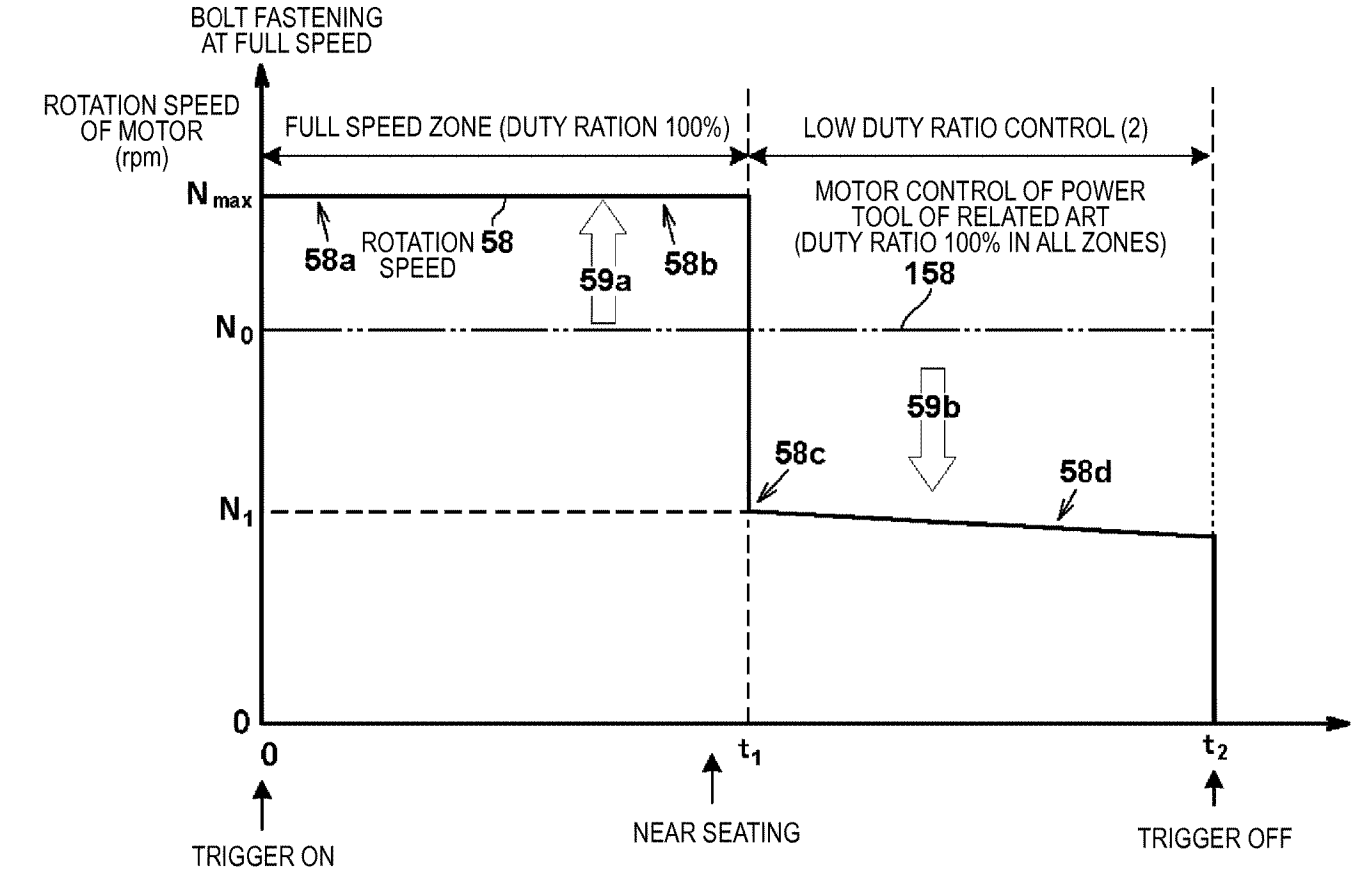
FIG. 5 A control method of a duty ratio of the impact tool 1 according to the illustrative embodiment of the invention, showing a relation between a rotation speed 58 of the motor and the duty ratio.

Next, a method of controlling a duty ratio of the impact tool 1 according to the illustrative embodiment is described with reference to FIG. 5. In an impact driver using a brushless DC motor of the related art, after an operator turns on (pulls) the trigger 8 at time t0 and the motor 3 starts to rotate, an upper limit of a duty ratio (a setting value of the duty ratio when the trigger is pulled to the maximum) is controlled to 100% in all zones, and the rotation speed 158 of the motor is constant as shown with a dashed-two dotted line (although the rotation speed may be actually varied due to a change in the load, it is not considered here). At time $t_2$, when the operator turns off (releases) the trigger, the rotation of the motor 3 stops. In contrast, in this illustrative embodiment, the upper limit of the duty ratio is controlled to 100% until the operator pulls the trigger 8 and thus the motor 3 starts to rotate at time t0 so that the motor 3 is driven at full speed. Then, after it is determined that the impact operation is performed one or more times and a screw or bolt, which is a fastening target, is seated, the duty ratio is drastically lowered at time $t_1$, so that the motor is controlled at the low duty ratio. By this control, the rotation speed of the motor 3 becomes $N_{max}$ and is controlled to be substantially constant from a zone 58*a* to a zone 58*b* indicated by arrows. After that, as shown with an arrow 58*c*, the rotation speed 58 of the motor 3 is sharply decreased and is controlled, as shown with an arrow 58*c*, and the motor 3 is rotated at a low speed until the operator releases the trigger 8. The rotation speed of the motor 3 is gradually decreased as the load is increased, from an arrow 58*c* to an arrow 58*d*.

In this illustrative embodiment, the battery 11 having the same voltage and the same capacity is used. However, the output of the motor 3 is higher than that of the related art. For example, regarding the motor of the related art, a size, a core part of the stator 4 and the rotor 5 are the same in terms of the shape, whereas the winding number of the winding 4*a* is decreased, a line diameter of the winding 4*a* is increased to supply the larger current to the winding 4*a* and the rotation speed of the motor 3 is increased to increase the output. In the meantime, if the motor control is performed in the way of the related art (the continuous driving is made at the duty ratio of 100% until the trigger is released) at a state where the output is increased, it is not preferable because the temperature is excessively increased and a serious situation is thus made as regards the heat and the load is increased in the motor 3 and the mechanism part such as the impact mechanism 21 when the trigger-off timing of the operator is delayed after the seating. However, according to the invention, the high-power motor 3 is adopted, so that the motor 3 is driven at the full speed (high speed) up to time $t_1$ at which it is determined that a plurality of striking is performed and the seating is made. Thereby, as compared to the method of the related art, the rotation speed is increased in the zone in which the load is light, as shown with an arrow 59*a*, and after time $t_1$, the rotation speed is largely decreased in the zone in which the striking is repeatedly performed, as shown with an arrow 59*b*, so that the load is reduced in the motor 3 or mechanism part. By this control, it is possible to complete the fastening in a short time by using the high-output motor and to improve the durability of the motor or mechanism part.

Figure 6:
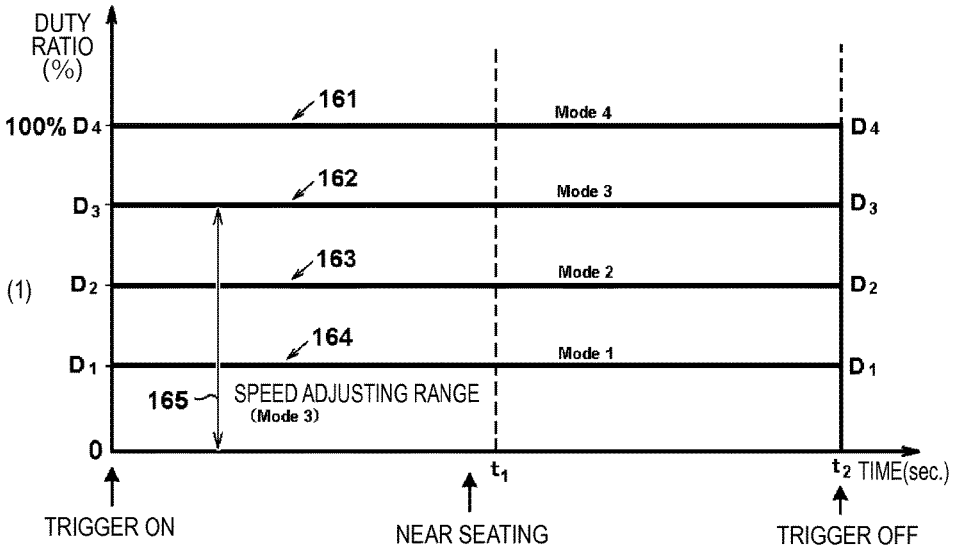
FIG. 6 A setting method of the duty ratio at each operation mode of the impact tool, in which (1) shows a setting method of the related art, and (2) shows the setting method of this illustrative embodiment.
Figure 6:
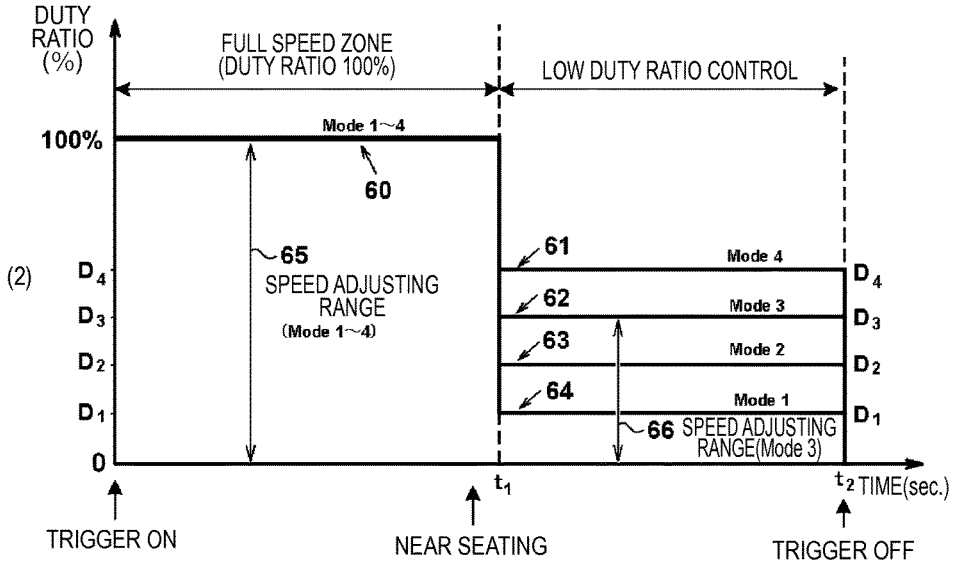

FIG. 6 illustrates a setting method of the duty ratio in the impact mode, in which (1) shows a setting method of the related art and (2) shows the setting method of this illustrative embodiment. In both figures, a vertical axis indicates the upper limit of the duty ratio and a horizontal axis indicates time. The impact tool 1 that is premised in this illustrative embodiment has four modes of a mode 1 to a mode 4, as the impact operation. The modes are switched whenever the toque changeover switch 54 provided on the operation panel 55 is pressed. When the mode is switched, the rotation speed of the motor 3 is switched. For example, in the mode 1 where the fastening torque is lowest (about 1), the rotation speed of the motor 3 is 900 revolutions/minute at a state where the trigger 8 is pulled to the maximum, in the mode 2 (about 2), the rotation speed of the motor 3 is 1,500 revolutions/minute, in the mode 3 (middle), the rotation speed of the motor 3 is 2,200 revolutions/minute and in the mode 4 (strong) where the fastening torque is highest, the rotation speed of the motor 3 is 2,900 revolutions/minute. In order to set the rotation speed of the motor 3 in this way, the control means sets the duty ratios D1 to D4, as shown with arrows 161 to 164. Here, the duty ratio D4 is 100%. The duty ratios (maximum value) D1 to D4 are constant. For example, in the mode 3, the duty ratio is set within a range of 0 to D3, depending on a pulling amount of the trigger 8, as shown with an arrow 165. Here, when the motor 3 is rotated at a state where the operator pulls the trigger 8 to the maximum, the constant control of the same duty ratio is performed near a position at which the seating is made, even after time $t_1$. In order to perform the control, according to the impact tool of the related art, the rated motor 3 is selected which does not cause the thermal or mechanical strength problem even when the motor 3 is continuously driven at the duty ratio of 100%, as shown with the arrow 161.

In this illustrative embodiment, as shown in FIG. 6(2), the duty ratio is set to 100% in any of the modes 1 to 4 until at least the seating is made, here up to time $t_1$, so that the motor 3 is driven at the highest speed. From time t0 to time $t_1$, the duty ratio is controlled within a range of 0 to 100% in any mode, depending on the pulling amount of the trigger 8, as shown with an arrow 65. On the other hand, at time $t_1$, the duty ratio is decreased to one of D1 to D4, depending on the set mode, as shown with arrows 61 to 64. Here, D4 is about 60% and D1 to D3 are 15%, 30% and 45%, respectively. In the meantime, the control on the decrease degree of D4 is arbitrary. The maximum (here, D4) of the low duty ratio is preferably lowered from 100% by 10 percent or more. When D4 is controlled to 70% or lower, the high effect can be obtained. In FIG. 6(2), in the mode 3, the duty ratio is controlled within a range of 0 to D3, depending on the pulling amount of the trigger 8, as shown with an arrow 66. In this illustrative embodiment, when the motor is driven in the impact mode, the motor is controlled with full power up to time $t_1$, irrespective of whether any of the modes 1 to 4 is set, and the maximum duty value is changed depending on each mode value, after time $t_1$. Therefore, it is possible to quickly complete the fastening operation by using the higher-output, higher rotation motor, as compared to the related art. In the meantime, a combination of the high duty ratio and the low duty ratio may be set in each mode, instead of the configuration where the high duty ratio is all set to 100%. For example, the high duty ratio and the low duty ratio may be set in each mode so that a relation of the high duty ratio and the low duty ratio becomes 100% and 60% in the mode 4, is 90% and 45% in the mode 3, is 60% and 30% in the mode 2 and is 30% and 15% in the mode 1, for example. Also, as a separate control method, when the pulling amount of the trigger is a predetermined value or larger, for example a half or larger in the zone from time t0 to time $t_1$, the calculation unit 40 may fix the duty ratio to 100% so that the motor is controlled at full speed.

Figure 7:
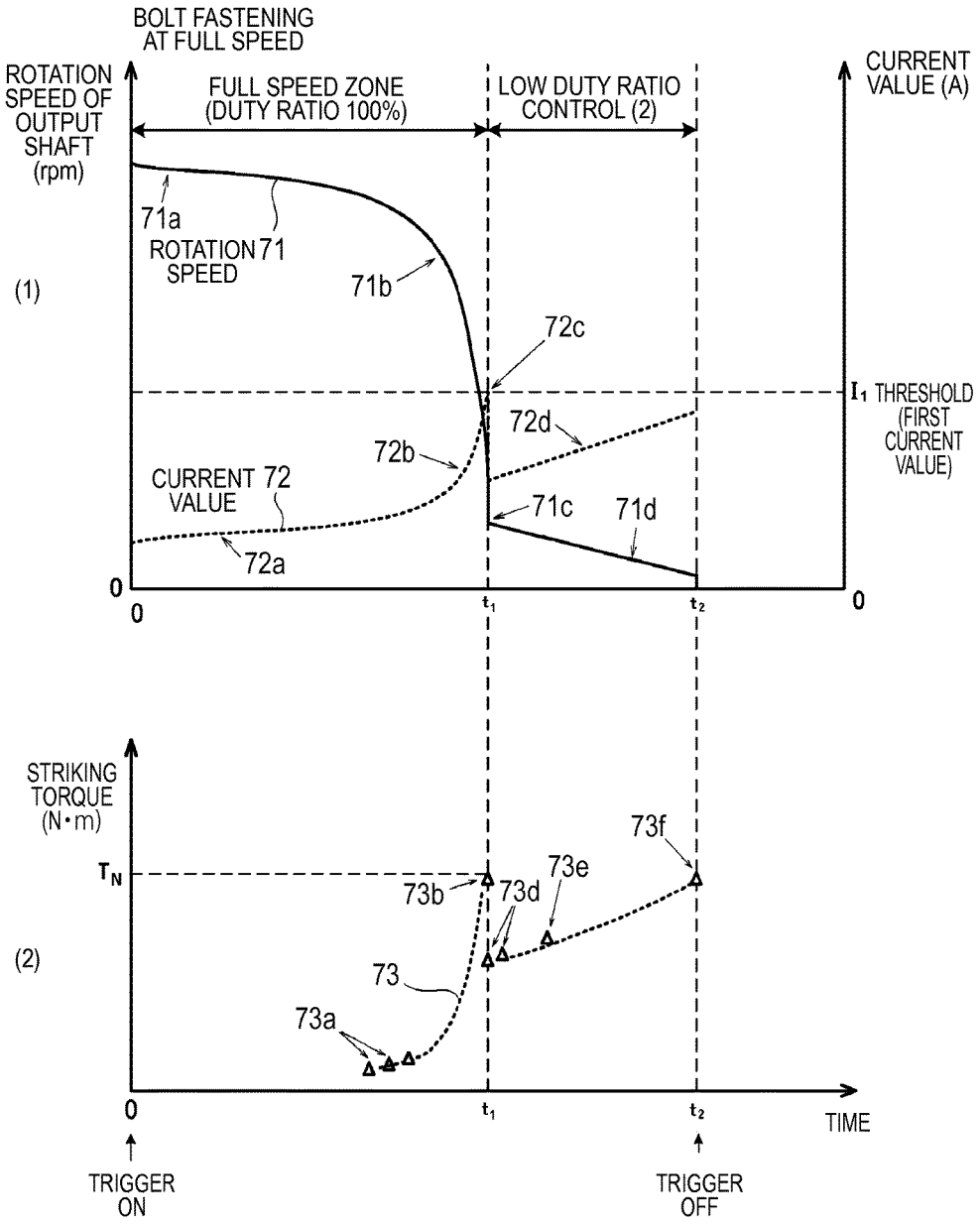
FIG. 7 (1) is a graph showing a relation among a rotation speed of an output shaft, a motor current value and a duty ratio of a PWM driving signal when performing a full speed bolt fastening operation in the impact tool according to the illustrative embodiment of the invention, and (2) shows a magnitude of striking torque at that time.

FIG. 7(1) is a graph showing a relation among a rotation speed of the tip, a motor current value and a duty ratio of a PWM driving signal when performing a bolt fastening operation at full speed in the impact tool according to the illustrative embodiment of the invention. FIG. 7(2) shows a magnitude of striking torque at that time. As described in FIGS. 5 and 6, in this illustrative embodiment, from the seating until the predetermined striking is over, the motor 3 is rotated with the maximum rotation speed of the duty ratio 100% to thus rotate the tip tool at a high speed, irrespective of the operation modes. At time $t_1$ at which the predetermined striking torque is reached, the duty ratio is controlled to be decreased from 100% to the duty ratio corresponding to each set mode. When performing the control in this way, the rotation speed 71 of the output shaft (=the rotation speed of the tip tool) is changed from the substantially constant rotation speed in a free run period shown with an arrow 71*a* to the sharp rotation reduction before and after the seating, as shown with an arrow 71*b*. The reduction of the rotation speed 71 of the output shaft in this way is because the hammer 24 of the impact mechanism 21 retreats to start the striking operation. A current value 72 detected by the current detection circuit 41 (refer to FIG. 4) is substantially constant in the free run period near an arrow 72*a* and is gradually increased. However, the current value is rapidly increased near the seating of the bolt or screw due to the sharp increase of the reaction force (load) applied from the tip tool, as shown with an arrow 72*b*. At time indicated by an arrow 72*c*, when the current value exceeds a threshold $I_1$, the duty ratio is decreased from 100% to a predetermined value corresponding to the operation mode. After time $t_1$, the rotation speed 71 is reduced from a value indicated by an arrow 71*c* to a value indicated by an arrow 71*d* due to the increase in the load. At time $t_2$, when the operator releases the trigger 8, the motor 3 stops. On the other hand, the current value flowing through the motor 3 is gradually increased, as indicated by an arrow 72*d*, but does not exceed the threshold $I_1$ because the duty ratio is drastically decreased. Therefore, it is possible to prevent the heat generation of the inverter circuit or motor 3, which is caused as the excessive current flows.

FIG. 7(2) shows a magnitude of striking torque 73 at the state shown in FIG. 7(1). In these (1) and (2), the horizontal time axes are matched. Also, some timings at which the striking is performed are indicated by triangular marks. Although only the representative triangular marks are shown, a plurality of striking is continuously performed from the first triangular mark (an arrow 73*a*) to the final triangular mark 73*f*. As can be understood from these drawings, the striking operation by the impact mechanism 21 starts near an arrow 73*a*. In the impact tool 1 of this illustrative embodiment, the striking is performed about 10 to 30 times every second. At time indicated by the arrow 73*a* at which the striking starts, the set duty ratio is 100%, and an increase rate of the current value 72 is increased while the plurality of striking is performed. When the current becomes the threshold $I_1$ or greater, it is determined that the seating is completed, and the duty ratio is thus decreased. Here, the threshold $I_1$ is set so that the striking, which is indicated by an arrow 73*b* and is performed at time $t_1$, becomes a fastening torque value TN corresponding to the set operation mode. The threshold $I_1$ is set for each operation mode, and an optimal value thereof is set by a test and the like upon product development and is preferably stored beforehand in the microcomputer and the like. After time $t_1$, the duty ratio is decreased. However, since the striking torque having a sufficient magnitude is generated, as shown by arrows 73*d*, 73*e*, the screw or bolt can be securely fastened. The value of the duty ratio to be decreased is preferably set so that the striking torque value indicated by an arrow 73*f* at time $t_2$ at which the operator releases the trigger 8 does not exceed the fastening torque value indicated by the arrow 73*b*. In the meantime, regarding the value of the duty ratio, which is to be decreased in each mode, an optimal value thereof is set by a test and the like upon product development and is preferably stored beforehand in the microcomputer and the like.

Figure 8:
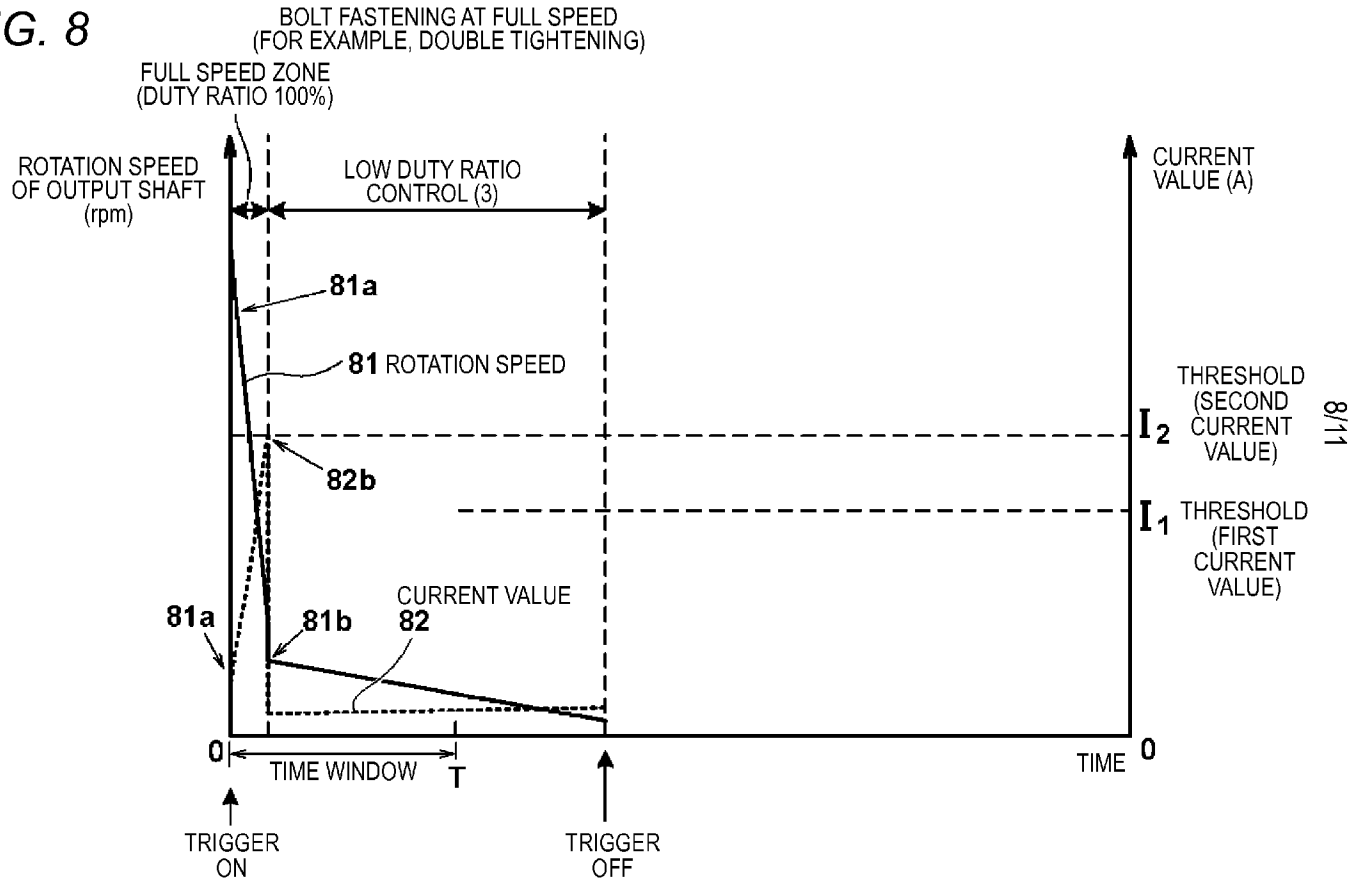
FIG. 8 A graph showing a relation among the rotation speed of the output shaft, the motor current value and the duty ratio of a PWM driving signal in the impact tool according to the illustrative embodiment of the invention (in the case of tightening a fixed bolt twice).

Next, a relation among the rotation speed of the output shaft, the motor current and the duty ratio of the PWM driving signal when tightening the fixed bolt twice is described reference to FIG. 8. As described in FIGS. 4 to 7, when the control is performed so that the motor 3 is driven at the highest speed in the free run period, if the operator intends to tighten twice the fastened bolt or screw for any reason, a head of the bolt or screw is broken or the excessive force is applied to the motor or mechanism, which is not preferable. Therefore, in the impact tool 1 of this illustrative embodiment, a second current value $I_2$ greater than the first threshold $I_1$ is set and a state where the double tightening operation is performed is detected at an early stage. When the state is detected, the duty ratio is controlled to be immediately decreased. Here, a time window (here, from the trigger startup to time T) for setting a detection zone for detecting double tightening is set, and timing at which the duty ratio is decreased by the second threshold $I_2$ instead of the first threshold $I_1$ is determined in the time window. When the time T elapses, the timing at which the duty ratio is decreased by the first current value $I_1$ is switched. At time t0, when the operator pulls the trigger, since the bolt, which is a fastening target, has been already fastened, the rotation speed of the tip tool is rapidly reduced, as shown with an arrow 81*a*. Also, since the load is high, the current value 82 is sharply increased, as shown with an arrow 82*a*, and reaches the second threshold $I_2$ at time indicated by an arrow 82*b*. At that point in time, the duty ratio, which is 100% until then, is controlled to be changed to a lower duty value. When the operator pulls the trigger 8, the motor 3 stops. However, since the current value 82 after decreasing the duty ratio is sufficiently smaller than the first threshold $I_1$, the current value does not exceed the first threshold $I_1$. In this way, the second threshold $I_2$ for double tightening detection is used for the predetermined time window after the trigger is pulled, and the method described in FIGS. 4 to 7 is adopted after the time window elapses. Therefore, upon the normal tightening of the screw or bolt, even when the double tightening is tried for any reason, it is possible to effectively prevent the damage of the motor.

Figure 9:
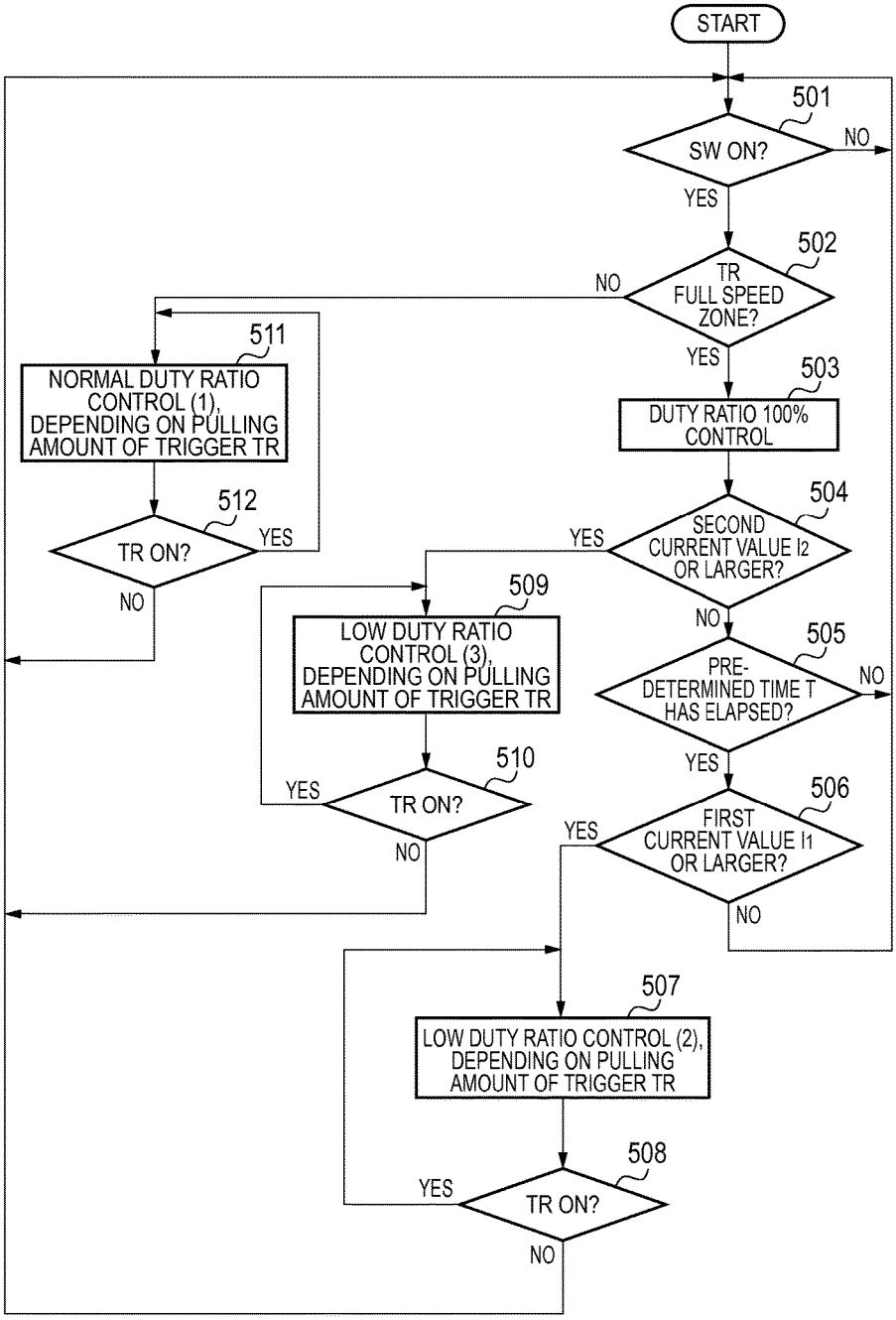
FIG. 9 A flowchart showing a setting sequence of the duty ratio when performing a fastening operation using the impact tool 1 according to the illustrative embodiment of the invention.

Subsequently, a setting sequence of the duty ratio for motor control of the impact tool 1 according to an illustrative embodiment of the invention is described with reference to a flow chart of FIG. 9. The control sequence shown in FIG. 9 can be realized in a software manner by enabling the calculation unit 40 having a microprocessor to execute a computer program, for example. First, the calculation unit 40 detects whether the trigger (TR) 6 is pulled and turned on by an operator (step 501). When it is detected that the trigger is pulled, the calculation unit proceeds to step 502. Then, the calculation unit 40 determines whether a pulling amount of the trigger 8 is a maximum amount, i.e., the motor is within a full speed area (step 502). When it is determined in step 502 that the motor is not within the full speed area, for example, when the trigger 8 is pulled only by half, the calculation unit performs the normal duty ratio control, depending on the pulling amount of the trigger (step 511). For example, when the trigger is pulled by half, the pulling amount and the duty ratio value are preferably associated with each other proportionally or by a predetermined relation equation, for example, the duty ratio is decreased by half. Then, in step 512, the calculation unit determines whether the trigger 8 is kept at the on state. When it is determined that the trigger 8 is returned, the calculation unit returns to step 501, and otherwise, returns to step 511.

When it is determined in step 502 that the pulling amount of the trigger 8 is a maximum amount, i.e., the motor is within the full speed area, the calculation unit 40 sets the duty ratio to 100% and drives the motor 3 (step 503). Then, the calculation unit 40 determines whether the current value detected by the current detection circuit 41 (refer to FIG. 4) is equal to or greater than the second threshold $I_2$ (step 504). Here, when the current value is equal to or greater than the second threshold $I_2$, it means the double tightening described in FIG. 8. Therefore, the calculation unit changes the duty ratio from 100% to a low value to thus perform the low duty ratio control (3), depending on the pulling amount of the trigger (step 509). In the meantime, the low duty ratio (3) is preferably set to be different for each mode, like the low duty ratio (2) shown in FIG. 6(2). Also, the duty ratio is preferably set so that the low duty ratio (2) and the low duty ratio (3) are not the same and are different, preferably the low duty ratio (3) is lower than the low duty ratio (2). Then, in step 510, the calculation unit determines whether the trigger 8 is kept at the on state. When it is determined that the trigger 8 is returned, the calculation unit returns to step 501, and otherwise, returns to step 509.

When it is determined in step 504 that the current value detected by the current detection circuit 41 (refer to FIG. 4) is smaller than the second threshold $I_2$, the calculation unit determines whether the time window for setting the detection zone for detecting the double tightening, i.e., the predetermined time T has elapsed (step 505). When it is determined that the predetermined time T has not elapsed, the calculation unit returns to step 501 (step 505). When it is determined in step 505 that the predetermined time T has elapsed, the calculation unit determines whether the current value is equal to or greater than the first threshold $I_1$. When it is determined that the current value is smaller than the first threshold $I_1$, the calculation unit returns to step 501 (step 506). Here, when the current value is equal to or greater than the first threshold $I_1$, the calculation unit changes the duty ratio value from 100% to a low value, as described in FIG. 6(2), thereby performing the low duty ratio control (2), depending on the pulling amount of the trigger (step 507). Then, in step 508, the calculation unit determines whether the trigger 8 is kept at the on state. When it is determined that the trigger 8 is returned, the calculation unit returns to step 501, and otherwise, returns to step 507.

As described above, according to the control of this illustrative embodiment, the motor is rotated at the high speed (the duty ratio 100%) until the impact reaches release torque and the striking starts in the motor having the large non-load rotation speed, and when it is determined that the plurality of striking is continuously performed, the duty ratio is controlled to be decreased from the high duty ratio to the low duty ratio. Therefore, it is possible to implement the impact tool capable of preventing the excessive fastening and suppressing the temperature increase of the motor to thus quickly complete the fastening. Also, when the sands are caught in the screw, for example, the torque is instantaneously increased, so that the striking may be performed only one time. At this time, if the control of decreasing the duty ratio is immediately performed in a situation where the current value just becomes a value or larger corresponding to the first striking, the duty ratio is immediately decreased after only one striking is performed in the situation where the sands are caught in the screw, and the screw tightening thereafter is delayed. According to the present invention, the duty ratio is decreased when it is determined that the screw tightening is continuously performed in a state where the torque is increased due to the plurality of striking. Therefore, it is possible to solve the problem of the tightening deficiency.

In this illustrative embodiment, the switching from the high duty ratio to the low duty ratio is made on the basis of the magnitude of the current value 72. However, the present invention is not limited thereto. For example, a following method is possible. An increase rate of the current value 72 per unit time near the arrow 72*b* of FIG. 7(1) is monitored. When the increase rate is continuously kept at a high state for a predetermined time period, the duty ratio is switched from the high duty ratio to the low duty ratio. By this configuration, it is possible to check that the screw is continuously being tightened at the high torque state. The method of monitoring the increase rate of the current value 72 may be implemented by a well-known current increase rate monitoring method of calculating a differential value of current values detected every short time interval, for example. Also, a configuration is possible in which the power tool uses a torque sensor configured to detect a magnitude of the fastening torque value, a seated state of the fastening tool is correctly detected by the torque sensor and the duty ratio is decreased after confirming the seating. In this way, since the screw is continuously tightened at the high duty ratio until the seating is made, it is possible to fasten the screw with the high torque from the free run state to the moment of the seating. Thereafter, the duty ratio is decreased and the fastening is continuously performed, so that the fastening torque comes close to a predetermined value and a deviation of the fastening torque for each screw can be thus suppressed.

Second Illustrative Embodiment

Figure 10:
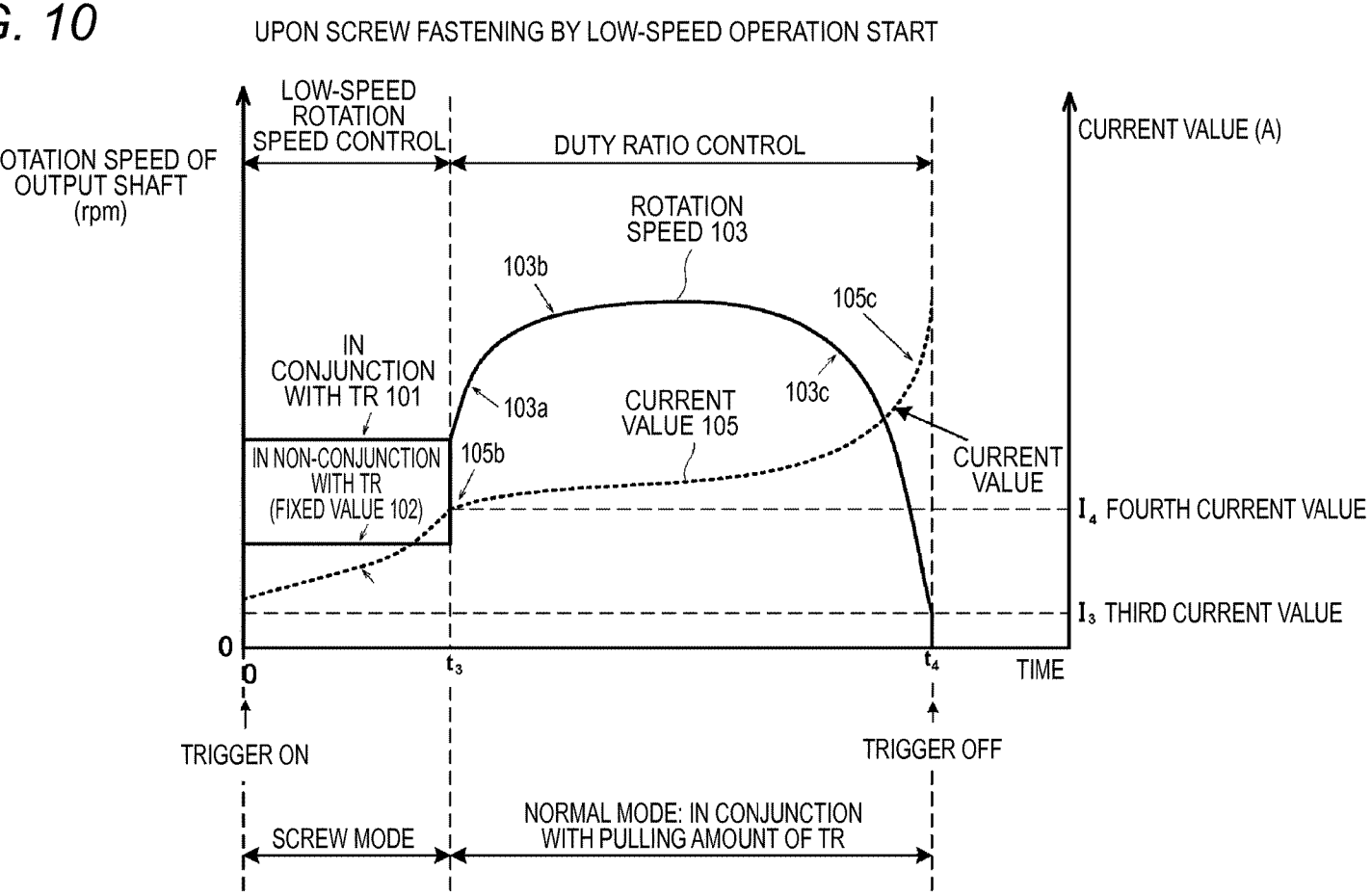
FIG. 10 A graph showing a relation among the rotation speed of the output shaft, the motor current value and the duty ratio of a PWM driving signal according to a second illustrative embodiment of the invention.
Figure 11:
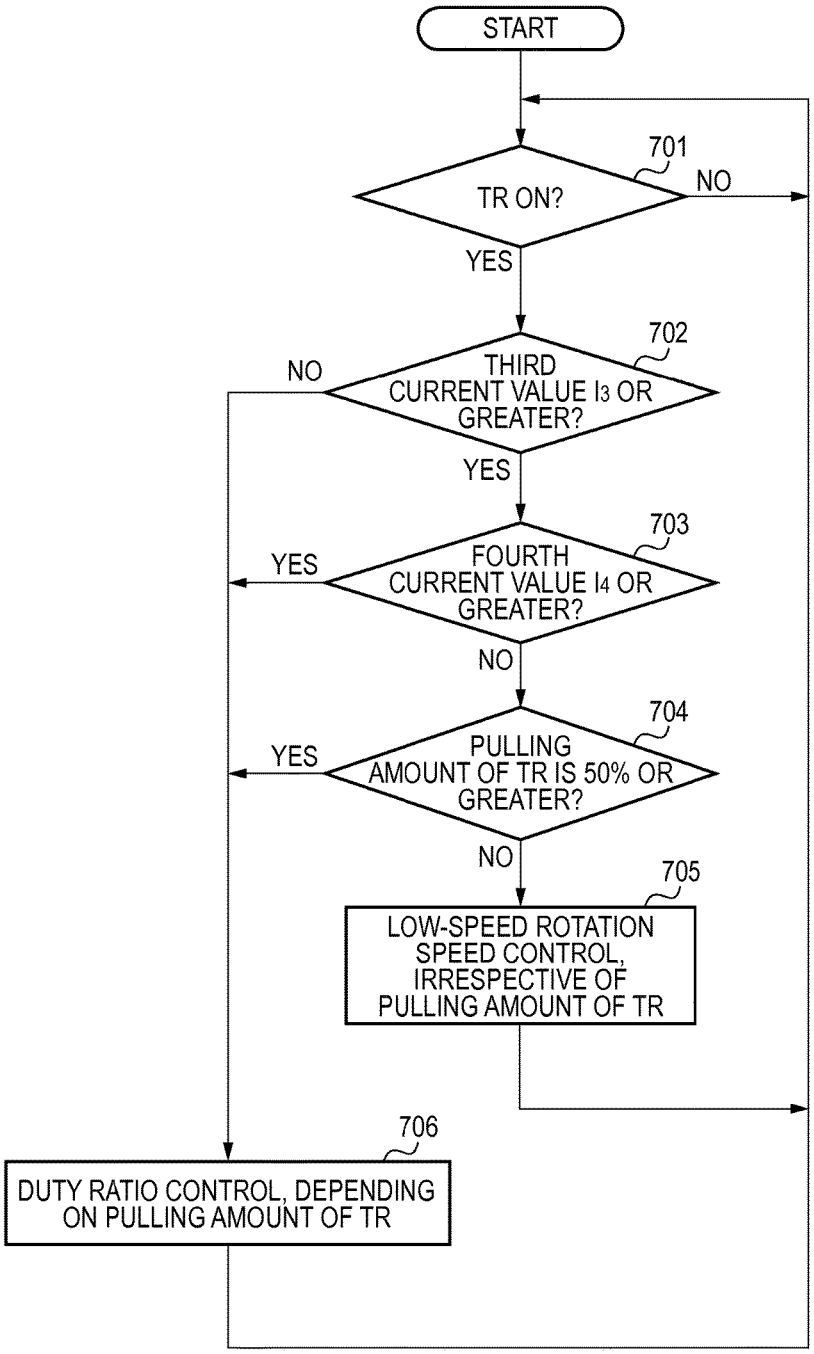
FIG. 11 A flowchart showing a setting sequence of the duty ratio when fastening a wood screw using the impact tool 1 according to the second illustrative embodiment of the invention.

In the below, a second illustrative embodiment of the invention is described with reference to FIGS. 10 and 11. In the first illustrative embodiment, when the control is performed at the high duty ratio until a plurality of striking is performed, the rotation speed of the motor is excessively high during the initial fastening operation of a wood screw and the like, so that it may be difficult to use the tool. Thus, in a second illustrative embodiment, a control method by a 'screw mode' in which a wood screw is enabled to securely bite the wood, which is a target material, is implemented. In the second illustrative embodiment, when the operator pulls the trigger 2 with a small pulling amount, the control is performed so that the rotation speed is low and the speed is substantially constant. Thereby, the screw is prevented from falling down, so that the wood screw is securely bitten. FIG. 10 is a graph showing a relation among the rotation speed, the motor current and the duty ratio of a PWM driving signal in the tip tool according to the second illustrative embodiment of the invention.

In FIG. 10, when the screw mode is selected by a mode changeover switch, the motor is driven at the low speed with the limited rotation speed until a tip of the wood screw and the like stably bites the target material such as wood. Here, the operator pulls the trigger at time 0 and controls the rotation speed with any one of two modes in a short time period up to time $t_3$. One is a control mode in which the rotation speed is controlled in conjunction with the pulling amount of the trigger, and the rotation speed 101 at the control mode is constant. Here, the duty ratio is set to be sufficiently small. Thereby, even when the trigger is pulled to the maximum, the upper limit thereof is limited to be within the range of the rotation speed 101 of FIG. 10, so that the rotation speed is controlled depending on the pulling amount of the trigger 8. Here, the anvil, which is an output shaft, is preferably driven at the very low speed such as 1 to 100 rpm, and the duty ratio is 10% or lower, preferably 5% or lower at that time. In this illustrative embodiment, the output of the motor 3 may be set to be higher than the related art. In this case, the duty ratio is about 1%. In this way, the rotation speed is set so that the motor is rotated at the constant speed depending on the pulling amount of the trigger 8 from time 0 to time $t_3$. However, since the duty ratio is set to be very low, the operator can control the motor 3 so that the motor is rotated at the low speed.

In the other control, when the trigger 8 is pulled even if only slightly, the duty ratio is fixed, so that the motor is constantly rotated at the very low speed of the rotation speed 102. Here, the calculation unit 40 is configured to fix the rotation speed of the motor 3 to 50 rpm so that the fixed rotation speed is kept even when the trigger pulling amount by the operator is slightly changed. In this way, when the current value 105 gradually increases from a value indicated by an arrow 105*a* and exceeds a fourth current threshold $I_4$ at time $t_3$, the control is switched to the normal duty control and the rotation of the motor is controlled depending on the pulling amount of the trigger 8. When a predetermined condition is reached, the duty ratio is switched to the control that is performed in the normal rotation area described in the first illustrative embodiment, and the fastening is continuously performed. In this way, the screw mode is provided, so that the operator can stably perform the screwing operation by constantly rotating the motor 3 at the low speed at the early stage of the screwing operation.

When the motor is rotated at the normal mode after time $t_4$, the rotation speed 103 increases, as shown with an arrow 103*a*, becomes stable, as shown with an arrow 103*b*, and decreases, as shown with an arrow 103*c*, until the fastening is completed. At this time, when the current value 105 exceeds a value indicated by an arrow 105*b*, it is substantially constant for a while. However, the current value rapidly increases, as shown with an arrow 105*c*, at the time that the fastening is almost completed. In the below, a setting sequence of the duty ratio when fastening the wood screw by using the impact tool 1 of the second illustrative embodiment is described with reference to a flowchart of FIG. 11. First, the calculation unit 40 detects whether the trigger 8 is pulled and turned on by the operator. When the trigger is pulled, the calculation unit proceeds to step 702 (step 701). Then, the calculation unit 40 determines whether a pulling amount of the trigger 8 is within a range of the very small area. This is to determine whether the current value is equal to or greater than a third threshold $I_3$ and smaller than a fourth threshold $I_4$ (steps 702, 703). Here, when the current value is equal to or greater than the third threshold $I_3$ and smaller than the fourth threshold $I_4$, the calculation unit determines whether the pulling amount of the trigger is equal to or greater than 50% (step 704). Here, when the pulling amount of the trigger is equal to or greater than 50%, the calculation unit determines that the operation is the screwing operation of a bolt and the like, not the fastening operation of biting a wood screw and the like, and performs the normal duty control as described with reference to FIGS. 6 to 8 (steps 704, 706). When it is determined in step 704 that the pulling amount of the trigger is less than 50%, the calculation unit performs the low constant-speed rotation speed control as shown with the rotation speed 101 or 102 in FIG. 10. In this way, the calculation unit 40 determines the pulling amount of the trigger 8 by the operator to automatically detect the screwing operation of a wood screw and the like, thereby performing the optimal fastening control. Meanwhile, in the flowchart of FIG. 11, the calculation unit 40 is configured to automatically detect the screwing operation on the basis of the third and fourth thresholds $I_3$, $I_4$ and the pulling amount of the trigger 8. However, the 'screw mode' may be manually set by a dial and the like, rather than the automatic detection.

As described above, according to the second illustrative embodiment, the present invention can be applied to not only the impact tool but also the screw fastening tool such as a driver drill. Also, the screw mode is provided, so that it is possible to correctly position the fastening tool with respect to a member to be fastened at the early stage of the fastening operation. Also, the technical idea of the second illustrative embodiment can be applied to a cutoff tool for which it is necessary to position a blade at a cutoff position at an early stage of a cutoff operation, such as a saver saw. Further, the illustrative embodiment can also be applied to an operation of positioning a tip tool such as a whetstone at a cutting position at an early stage of a cutting operation using a cutting tool.

According to this illustrative embodiment, the operation is performed while optimally switching the duty ratio by using the plurality of current thresholds ($I_3<I_4<I_1<I_2$). Therefore, it is possible to precisely perform the fastening operation by using the high-output motor. Also, since the motor is rapidly rotated at the high duty ratio in the free-run part, it is possible to shorten the fastening time. Further, since the 'screw mode' at which the first partial fastening such as a wood screw is performed is provided, it is possible to stably perform the rotation control at the early stage of the fastening operation of the wood screw and the like by the calculation unit 40. Therefore, it is possible to remarkably reduce the phenomenon that the wood screw falls down because the initial biting is not made well.

Hereinabove, although the invention has been described with reference to the illustrative embodiments, the invention is not limited to the above-described illustrative embodiments but can be variously modified without departing from the gist of the invention. For example, although the impact tool to be driven by the battery has been described in the above-described illustrative embodiments, the invention is not limited to the cordless impact tool but can be similarly applied to an impact tool using a commercial power supply. Further, the control of changing the relation between the pulling amount of the trigger and the set duty ratio, which is performed after the trigger is pulled until the pulling is over, can also be applied to a power tool driving the brushless motor by the PWM control, for example a driver drill, an impact driver of a so-called electronic pulse type, and the like.

DESCRIPTION OF REFERENCE NUMERALS AND SIGNS

1: impact tool
2: housing
2*a*: trunk part
2*b*: handle part
2*c*: battery attaching part
3: motor
4: stator
4*a*: winding
5: rotor
5*a*: magnet
6: rotary shaft
7: switch circuit board
8: trigger
9: control circuit board
10: forward/reverse switching lever
11: battery
12: inverter circuit board
13: rotor fan
14: switching element
15: hammer case
17*a*: air inlet
17*b*: slit
18: slit
19*a*: bearing
19*b*: bearing
20: deceleration mechanism
21: impact mechanism
22: bearing
23: spring
24: hammer
25: spindle cam recess
26: ball
27: spindle
28: hammer cam recess
29: metal
30: anvil
30*a*: mounting hole
31: mounting mechanism
32: shunt resistance
33: position detection element (Hall IC)
34: temperature detection element (thermistor)
35: spacer
36: sleeve
37: power supply circuit
38: inverter circuit
39: control means
40: calculation unit
41: current detection circuit
42: switch operation detection circuit
43: applied voltage setting circuit
44: rotation direction setting circuit
45: rotor position detection circuit
46: rotation speed detection circuit
47: temperature detection circuit
48: control signal output circuit
49: striking shock detection circuit
50: striking shock detection sensor
51: illumination means
52: display means
53: dial switch (second setting means)
54: torque changeover switch (first setting means)
55: operation panel
71: rotation speed
72: current value
73: striking torque
82: current value
100: duty ratio
101: rotation speed
102: rotation speed
103: rotation speed
105: current value
120: electrical angle
158: rotation speed of motor
201: motor current
202: duty ratio
203: fastening torque value

The invention claimed is:

1. A power tool comprising:

a motor configured to be driven by PWM controlling a semiconductor switching element;

a trigger configured to adjust startup and rotation of the motor;

an impact mechanism configured to strike or rotate an anvil by a hammer that is rotated by the motor;

a control device configured to control rotation of the motor, wherein the power tool has a plurality of operation modes having different fastening torques, wherein the power tool is configured to perform control at the same duty ratio, irrespective of the operation modes, in a control zone of a high duty ratio, and wherein the power tool is configured to perform control at a duty ratio set depending on each of the operation modes, in a control zone of a low duty ratio; and a current detection device configured to detect a current value flowing through the motor or a semiconductor switching element, wherein when a current value, which is detected by the current detection device when the power tool is driven at the high duty ratio, exceeds a first threshold $I_1$, the control device switches the duty ratio from the high duty ratio to the low duty ratio, and wherein when a plurality of striking is continuously performed by the impact mechanism, the motor is driven at a state where a duty ratio is changed from a high value to a low value.

2. The power tool according to claim 1, wherein the high duty ratio is 100% and the low duty ratio is 70% or lower.

3. The power tool according to claim 1, wherein a second threshold $I_2$ ($I_2>I_1$), instead of the first threshold $I_1$, is used in a short specific time period after the trigger is pulled, and when the current value exceeds the second threshold $I_2$, the control device switches the duty ratio from the high duty ratio to the low duty ratio.

4. A power tool comprising:

a motor configured to be driven by PWM controlling a semiconductor switching element;

a trigger configured to adjust startup and rotation of the motor;

an impact mechanism configured to strike or rotate an anvil by a hammer that is rotated by the motor;

a control device configured to control rotation of the motor; and a current detection device configured to detect a current value flowing through the motor or semiconductor switching element, wherein when an increase rate of a current value detected by the current detection device is continuously kept at a high state, the motor is driven at a state where a duty ratio is changed from a high value to a low value, wherein the power tool has a plurality of operation modes having different fastening torques, wherein the power tool is configured to perform control at the same duty ratio, irrespective of the operation modes, in a control zone of a high duty ratio, and wherein the power tool is configured to perform control at a duty ratio set depending on each of the operation modes, in a control zone of a low duty ratio.

5. A power tool comprising:

a motor configured to be driven by PWM controlling a semiconductor switching element;

a trigger configured to adjust startup and rotation of the motor;

an impact mechanism configured to strike or rotate an anvil by a hammer that is rotated by the motor;

a control device configured to control rotation of the motor; and a current detection device configured to detect a current value flowing through the motor or a semiconductor switching element, wherein when a fastening member is seated by a plurality of striking by the impact mechanism, the motor is driven at a state where a duty ratio is changed from a high value to a low value, wherein it is determined that the fastening member is seated when a current value, which is detected by the current detection device when the power tool is driven at a high duty ratio, exceeds a first threshold $I_1$, wherein the power tool has a plurality of operation modes having different fastening torques, wherein the power tool is configured to perform control at the same duty ratio, irrespective of the operation modes, in a control zone of the high duty ratio, and wherein the power tool is configured to perform control at a duty ratio set depending on each of the operation modes, in a control zone of a low duty ratio.

6. The power tool according to claim 1, wherein the control device is configured to drive the motor with PWM controlling the semiconductor switching element at a high duty ratio until striking of the anvil by the hammer is started.

7. The power tool according to claim 4, wherein the control device is configured to drive the motor with PWM controlling the semiconductor switching element at a high duty ratio until striking of the anvil by the hammer is started.

8. The power tool according to claim 5, wherein the control device is configured to drive the motor with PWM controlling the semiconductor switching element at a high duty ratio until striking of the anvil by the hammer is started.

* * * * *